US005979875A

United States Patent [19]

Yocum

[11] Patent Number: 5,979,875

[45] Date of Patent: Nov. 9, 1999

[54] MECHANICAL JACK TRANSMISSION

[76] Inventor: David C. Yocum, 557 S. 600 West, Orem, Utah 84057

[21] Appl. No.: 08/916,115

[22] Filed: Aug. 21, 1997

[51] Int. Cl.[6] ..... B66F 3/02

[52] U.S. Cl. ..... 254/95

[58] Field of Search ..... 254/95, 97, 427, 254/6 R, 6 B, 6 C; 74/49, 50, 89, 422

[56] References Cited

U.S. PATENT DOCUMENTS

| | | |
|---|---|---|
| 189,468 | 4/1877 | Johnson . |
| 278,317 | 5/1883 | Dawson . |
| 287,066 | 10/1883 | Thom . |
| 444,427 | 1/1891 | Edwards . |
| 1,029,447 | 6/1912 | Jantzen . |
| 1,228,015 | 5/1917 | Gates et al. . |
| 1,410,968 | 3/1922 | Urquhart . |
| 1,584,087 | 5/1926 | Gelder . |
| 2,099,487 | 11/1937 | Johnson et al. . |
| 2,383,204 | 8/1945 | Le Veque . |
| 2,688,881 | 9/1954 | Crossland . |
| 3,715,102 | 2/1973 | Braselmann . |
| 3,765,651 | 10/1973 | Lifferth . |
| 3,850,042 | 11/1974 | Lifferth . |
| 4,781,285 | 11/1988 | Schlatter et al. . |
| 4,934,511 | 6/1990 | Wood, III et al. . |
| 5,020,777 | 6/1991 | Yocum . |
| 5,454,466 | 10/1995 | Galarowic . |
| 5,533,844 | 7/1996 | Ekleberry . |

*Primary Examiner*—Robert C. Watson
*Attorney, Agent, or Firm*—Clayton Howarth & Cannon, P.C.

[57] ABSTRACT

A mechanical lifting jack. The jack includes a single gear rack having a single row of spaced-apart teeth. A gear member having two pin members is held in meshing engagement with the gear rack by a gear housing circumscribing the gear rack. The teeth of the gear rack collectively define a teeth profile line. The gear member is rotatable about an axis of rotation, and is held by the gear housing such that the axis is maintained interiorly of the teeth profile line as the gear member operates and engageably advances along the gear rack. The pin members preferably reside on opposing sides of the axis of rotation and the teeth are sufficiently long to define gaps therebetween that are longer than diameters of the pin members, structural conditions which combine with the position of the axis to enable the pin members to impose forces against and normal to upper surfaces of the teeth.

20 Claims, 2 Drawing Sheets

MECHANICAL JACK TRANSMISSION

BACKGROUND OF THE INVENTION

1. The Field of the Invention

The present invention relates generally to mechanical transmission devices. More particularly, it concerns a mechanical jack transmission which incorporates a single gear rack and pinion gear system for lifting or lowering a load.

2. The Background Art

Mechanical lifting jacks are known in the prior art for lifting vehicles and other loads. One of the principal aspects of every mechanical jack is the transmission mechanism by which an external applied force is transmitted to the load to be lifted.

Some prior art mechanical jacks are specially designed for high lifting. Such jacks often involve one or more gear racks with rotational gearing disposed in meshing engagement with the gear rack. The prior art designs involving gear racks are characterized by the disadvantage that unsafe backspin may occur during operation of the jack, causing the load carrier to plummet rapidly downward under the force of the load and thereby posing a serious risk of damage and injury. Some of the high-lift jacks have utilized spring-loaded pawl devices to solve the problem of unsafe backspin, while others have introduced additional gearing. Either solution introduces unneeded complexity and expense to the jack.

OBJECTS AND SUMMARY OF THE INVENTION

It is therefore an object of the present invention to provide a mechanical jack transmission device designed to inhibit backspin.

It is another object of the present invention to provide such a mechanical jack transmission device which is simple in design and manufacture.

It is a further object of the present invention to provide such a mechanical jack transmission device that has fewer mechanical moving parts.

The above objects and others not specifically recited are realized in a specific illustrative embodiment of a mechanical lifting jack. The jack includes a single gear rack having a single row of spaced-apart teeth. A gear member having two pin members is held in meshing engagement with the gear rack by a gear housing circumscribing the gear rack. The teeth of the gear rack collectively define a teeth profile line. The gear member is rotatable about an axis of rotation, and is held by the gear housing such that the axis is maintained interiorly of the teeth profile line as the gear member operates and engageably advances along the gear rack. The pin members preferably reside on opposing sides of the axis of rotation and the teeth are sufficiently long to define gaps therebetween that are longer than diameters of the pin members, structural conditions which combine with the position of the axis to enable the pin members to impose forces against and normal to upper surfaces of the teeth.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
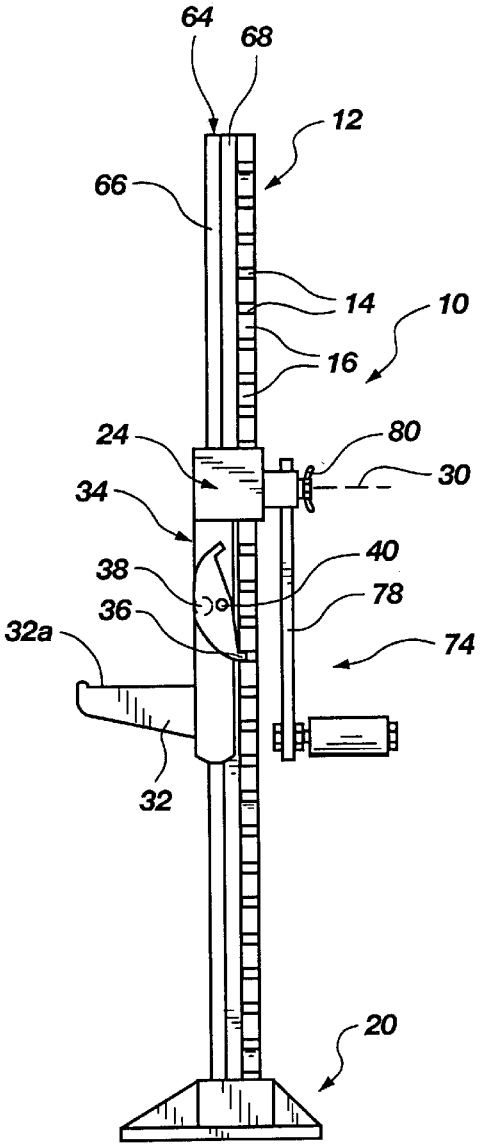
FIG. 1 is a frontal view of a mechanical jack made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated device, and any additional applications of the principles of the invention as illustrated herein, which would normally occur to one skilled in the relevant art and in possession of this disclosure, are to be considered within the scope of the invention claimed.

Applicant has discovered that the workings of a single rack lifting jack are greatly enhanced by increasing the length of the rack teeth and positioning the meshing gear action deeper between the teeth. This permits application of normal forces between the gear pinions and the upper surface of the teeth, which provides a more stable jack transmission mechanism and helps inhibit unsafe backspin.

Figure 2:
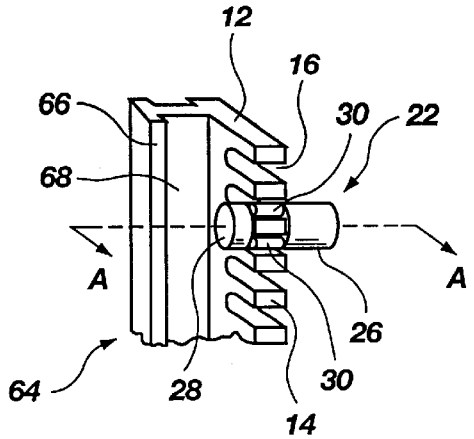
FIG. 2 is a perspective, break-away view of a portion of a gear rack of the jack of FIG. 1, disposed in meshing engagement with a gear member of the jack.
Figure 3:
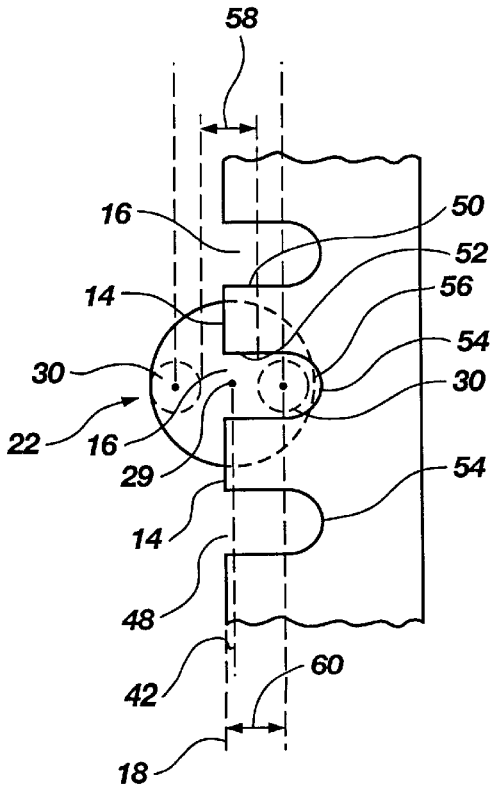
FIG. 3 is a side, break-away schematic view of the gear rack and gear member of FIG. 2.

Referring now to FIGS. 1–3, there is shown a lifting jack, designated generally at 10. The jack 10 includes a gear rack 12 having a row of spaced-apart teeth 14 defining a plurality of gaps 16 therebetween, said teeth 14 terminating in distal ends which collectively define a teeth profile line 18.

The jack 10 includes a support means 20 for supporting the gear rack 12 in a fixed position with the row of teeth 14 extending upwardly, preferably in a substantially vertical orientation. The support means 20 preferably comprises a suitable base support stand.

Figure 4:
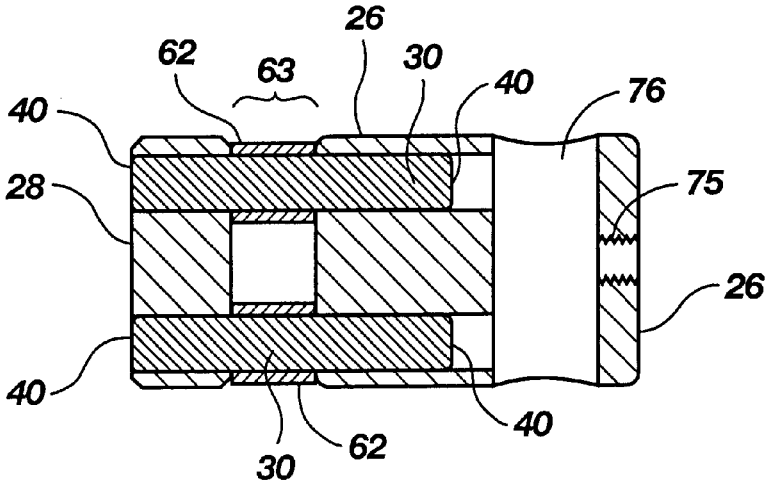
FIG. 4 is a side, cross-sectional view of the gear member of FIG. 2, taken along section A—A.

A gear member 22 is rotatably disposed within a gear housing 24, and has a first support wall 26 and a second support wall 28 and at least two pin members 30 extending between and intercoupling the support walls 26 and 28. The pin members 30 are cylindrical in shape, and preferably include rotatably disposed bushings 62 (shown in FIG. 4). The gear housing 24 constitutes a holding means for (i) intercoupling the gear member 22 and the gear rack 12, (ii) defining an axis of rotation 29 of the gear member 22, and (iii) holding said gear member 22 in a rotatable disposition relative to said gear rack 12 such that the axis of rotation 29 of said gear member 22 bisects said gear rack 12 and thereby resides interiorly of the teeth profile line 18, as shown most clearly in FIG. 3.

A load-bearing member 32 projects outwardly from the holding means 24, for supporting thereon a load to be lifted, such as an automobile (not shown).

The gear member 22 and gear rack 12 are cooperatively configured, dimensioned and positioned such that rotational movement of said gear member 22 causes the pin members 30 to move into and out of the gaps 16 and engage against the teeth 14 to thereby advance the gear member 22, holding means 24 and load-bearing member 32 along the gear rack 12.

It will be appreciated that the structure and apparatus disclosed herein is merely one example of a holding means 24 for intercoupling the gear member 22 and gear rack 12 as described herein, and it should be appreciated that any structure, apparatus or system for holding which performs functions the same as, or equivalent to, those disclosed herein are intended to fall within the scope of a holding means as claimed herein, including those structures, apparatus or systems for holding which are presently known, or which may become available in the future. Anything which functions the same as, or equivalently to, a holding means falls within the scope of this element.

Referring to FIGS. 1–4, it will be understood that each pin member 30 has opposing ends 40 and is sandwiched at said ends 40 between the support walls 26 and 28 of the gear member 22, such that at least a majority operative length 63 of each pin member 30 is suspended between said support walls 26 and 28 and free from any lateral attachment to rigid structure, such that said majority operative length 63 of each pin member 30 is completely surrounded by atmosphere.

Figure 5:
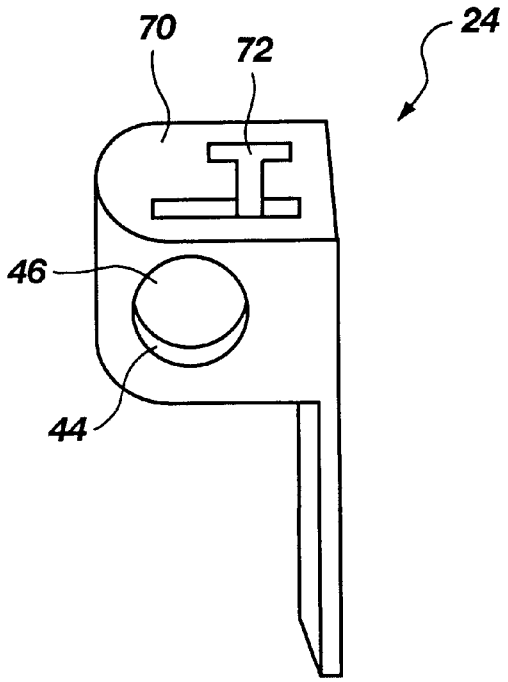
FIG. 5 is a perspective view of a gear housing of the jack of FIG. 1.

Referring to FIGS. 1, 3 and 5, the holding means 24 includes a means for holding the gear member 22 in a manner such that the axis of rotation 29 is maintained at a fixed distance with respect to the teeth profile line 18 during movement of said gear member 22 along the gear rack 12. The fixed distance may constitute a coincidence of the axis of rotation 29 with the teeth profile line 18, or, as shown in FIG. 3, there may exist some lateral distance 42 between the axis 29 and the teeth line 18 which preferably remains constant regardless of the position or orientation of the gear member 22 along the gear rack 12. This is accomplished by a circular edge 44 defining a circular passage 46 for receiving and holding the gear member 22. The lateral distance 42 is preferably $^{10}/_{1000}$ of an inch.

The pin members 30 have diameters, and the gaps 16 formed between the teeth 14 each have a length that is longer than the diameter of any of the pin members 30.

In operation, the gear member 22 is rotated about the axis of rotation 29, which is held fixed along a movement path 48 that is preferably parallel to the teeth profile line 18. The pin members 30 thereby engage against the upper surfaces 50 of the teeth 14, preferably by a force normal in direction to said upper surfaces 50, when the gear member 22 is rotated clockwise by reference to FIG. 3 to thereby move the load-bearing member 32 upwardly. If the load-bearing member 32 is used to drive a load downwardly, the pin members 30 would engage against the lower surfaces 52 of the teeth 14, preferably by imposing normally directed forces upon said lower surfaces 52, when the gear member 22 is rotated counterclockwise by reference to FIG. 3 to thereby move the load-bearing member 32 downwardly. However, if the load-bearing member 32 is simply carrying a load on the upper surface 32*a* either up or down, then the pins 32 will engage the upper surfaces 50 of the teeth 14 during both clockwise and counterclockwise rotation of the gear member 22.

The axis of rotation 29 being preferably maintained interiorly of the teeth profile line 18, enables the two pin members 30 to simultaneously engage against upper surfaces 50 of two adjacent teeth 14 (by normally directed forces) at a certain position of the gear member 22 along its rotational path, shown most clearly in FIG. 2. The simultaneous engagement of the two pin members 30 against the teeth 14, with the axes of the pin members 30 being disposed interiorly of the teeth profile line 18 to thereby enable normally directed forces between the pin members 30 and the teeth 14, provides a double-lock engagement helpful in inhibiting unsafe backspin. Users may selectively position a handle member 74 of the jack 10 in a rest position with the pin members 30 simultaneously engaged as just described, an arrangement sufficient to prevent backspin regardless of the amount of force applied to the load-bearing member 32, unless the handle member 74 is inadvertently jarred into action for which case a safety means 34 is provided as explained below in more detail.

Movement of the pin members 30 into the gaps 16 terminates at a fully inserted position for a certain position of the gear member 22, as shown in FIG. 3. Each gap 16 is bounded by an interior edge 54 of the gear rack 12 and a clearance space 56 resides between said interior edge 54 and a pin member 30 when said pin member 30 resides in the fully inserted position within said gap 16. It will be appreciated that each pin member defines a pin axis, and each pin axis bisects the boundaries of the gear rack 12, and thereby resides interiorly of the teeth profile line 18, when said pin member 30 resides in the fully inserted position within a gap 16.

The pin members 30 define a separation distance 58 therebetween, and the pin axis of each pin member 30 defines a pin overlap distance 60 from the teeth profile line 18 when said pin member 30 resides in the fully inserted position within a gap 16 (as shown in FIG. 3), and a ratio of the pin overlap distance 60 to the separation distance 58 is preferably within a range of approximately 0.7 to 1.3. More preferably, the ratio falls with a range of approximately 0.85 to 1.15, and most preferably equals 1.0.

The pin axes and the axis of rotation of the gear member 22 are all preferably disposed in a parallel orientation and all thereby preferably reside common to a single plane, such that both of the axes of the pin members 30 reside interiorly of the teeth profile line 18 at one position of the rotatably disposed gear member 22 to thereby enable simultaneous engagement of both pin members against upper surface of the teeth 14 at said one position.

The gear housing 24 slidably circumscribes the gear rack 12. It will be appreciated that the jack 10 includes a support body 64 formed in part from the gear rack 12, said support body 64 including an elongate skid surface 66 against which a portion of the gear housing 24 slides. The gear rack 12 and the skid surface 66 extend in parallel directions.

The support body 64 comprises an elongate central wall 68 intercoupling the skid surface 66 and the gear rack 12, said central wall 68 extending orthogonally between and with respect to the skid surface 66 and the gear rack 12. Further, the central wall 68 is attached at mid-portions of said skid surface 66 and gear rack 12, such that a cross section of the support body 64 resembles an "I" shape, shown most clearly in FIG. 2. The gear housing 24 includes an upper wall 70 having an "I" shaped throughpassage 72 formed therein, said "I" shaped throughpassage 72 being configured and dimensioned for receiving the support body 64 therethrough.

The jack 10 includes a handle member 74 releasably attachable to the gear member 22. Preferably, the gear member 22 includes a throughpassage 76 formed therein of a size and shape for receiving a section 78 of the handle member 74 therethrough, the jack 10 further comprising a set screw 80 threadably engaged with a threaded opening 75 (shown in FIG. 4) in the gear member 22 sufficient to engage against the section 78 of the handle member 74 responsive to turning of said set screw 80 to thereby enable said handle member 74 to be extendable out of and retractable into the throughpassage 76 of the gear member.

A safety means 34 is pivotally disposed on the holding means 24 for engaging the teeth 14 of the gear rack 12 to thereby inhibit backspin movement of the gear member 22. The safety means 34 is pivotally attached to the gear rack 12 at pivot connection 40, and includes at least one finger 36 configured and dimensioned to be insertable into the gaps 16 between the teeth 14 of the gear rack 12, and a spring means 38 for retractably pivoting the finger 36 toward the gear teeth 14.

The safety means 34 provides further protection against backspin, since movement of the gear member 22 is prevented when the finger 36 of the safety means 34 is inserted into one of the gaps 16. If a user desires to rotate the gear member 22 counterclockwise (in reference to FIG. 3) and thereby lower the load-bearing member 32, the user must first physically retract the finger 36 from the notch 16 in which it resides, before being able to do so. Accordingly, a conscious directional selection must be made before the jack 10 can be operated to lower the load-bearing member 32, and safety is thereby improved.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A lifting jack comprising:

a gear rack having a row of spaced-apart teeth defining a plurality of gaps therebetween, said teeth terminating in distal ends which collectively define a teeth profile line;

support means for supporting the gear rack in a fixed position with the row of teeth extending upwardly;

a gear member having a first support wall and a second support wall and at least two pin members extending between and intercoupling the support walls;

a holding means for (i) intercoupling the gear member and the gear rack, (ii) defining an axis of rotation of the gear member, and (iii) holding said gear member in a rotatable disposition relative to said gear rack such that the axis of rotation of said gear member bisects said gear rack and thereby resides interiorly of the teeth profile line;

a load-bearing member projecting from the holding means;

wherein the gear member and gear rack are cooperatively configured, dimensioned and positioned such that rotational movement of said gear member causes the pin members to move into and out of the gaps and engage against the teeth to thereby advance the gear member, holding means and load-bearing member along the gear rack;

wherein the movement of the pin members into the gaps terminates at a fully inserted position;

wherein the pin members define a separation distance therebetween, and wherein each pin has a pin axis that defines a pin overlap distance from the teeth profile line when said pin resides in the fully inserted position within a gap, and wherein a ratio of the pin overlap distance to the separation distance is within a range of approximately 0.7 to 1.3.

2. The lifting jack of claim 1, further comprising a safety means pivotally disposed on the holding means for engaging the teeth of the gear rack to thereby inhibit backspin movement of the gear member.

3. The lifting jack of claim 2, wherein the safety means further comprises:

at least one finger configured and dimensioned to be insertable into the gaps between the teeth of the gear rack; and a spring means for retractably pivoting the finger toward the gear teeth.

4. The lifting jack of claim 1, wherein each pin member has opposing ends and is sandwiched at said ends between the support walls of the gear member such that at least a majority operative length of each pin member is suspended between said support walls and free from any lateral attachment to rigid structure such that said majority operative length of each pin is completely surrounded by atmosphere, and wherein the holding means includes a means for holding the gear member in a manner such that the axis of rotation is maintained at a fixed distance with respect to the teeth profile line during movement of said gear member along the gear rack.

5. The lifting jack of claim 1, wherein the pin members have diameters and wherein the gaps formed between the teeth have a length that is longer than the diameter of any of the pin members.

6. The lifting jack of claim 1, wherein the movement of the pin members into the gaps terminates at a fully inserted position, and wherein each gap is bounded by an interior edge of the gear rack and wherein a clearance space resides between said interior edge and a pin member when said pin member resides in the fully inserted position within said gap.

7. The lifting jack of claim 1, wherein the movement of the pin members into the gaps terminates at a fully inserted position, and wherein each pin member defines a pin axis, and wherein each pin axis bisects the gear rack, and thereby resides interiorly of the teeth profile line, when said pin member resides in the fully inserted position within a gap.

8. The lifting jack of claim 1, wherein the ratio is within a range of approximately 0.85 to 1.15.

9. The lifting jack of claim 1, wherein the support means comprises a support base secured to the gear rack and being adapted to hold said gear rack in a substantially vertically disposed orientation.

10. The lifting jack of claim 1, wherein the holding means includes a means for holding the gear member in a manner such that the axis of rotation is maintained at a fixed distance with respect to the teeth profile line during movement of said gear member along the gear rack, such that said axis of rotation is confined to movement along a movement path that is parallel to the teeth profile line.

11. The lifting jack of claim 1, wherein the gear member is rotatably disposed in the holding means for rotational movement in either of first and second opposing rotational directions, and wherein the gear member and gear rack are cooperatively configured, dimensioned and positioned such that (i) rotational movement of the gear member in the first rotational direction causes the pin members to engage upper surfaces of the teeth to thereby advance the gear member, holding means and load-bearing member in a first direction along the gear rack, and (ii) rotational movement of the gear member in the second rotational direction causes the pin members to engage under surfaces of the teeth to thereby advance the gear member, holding means and load-bearing member in an opposing second direction along the gear rack.

12. The lifting jack of claim 1, wherein the pin members each include a pin axis and wherein the pin axes and the axis of rotation of the gear member are all disposed in a parallel orientation and all reside common to a single plane, such that both of the pin axes reside interiorly of the teeth profile line at one position of the rotatably disposed gear member to thereby enable simultaneous engagement of both pin members against upper surface of the teeth at said one position.

13. The lifting jack of claim 12, wherein the pin members are cylindrical in shape to thereby cause said pin members to simultaneously impose forces normal to and against the upper surface of the teeth at said one position.

14. The lifting jack of claim 1, wherein the holding means comprises a gear housing that slidably circumscribes the gear rack.

15. A lifting jack comprising:

a gear rack having a row of spaced-apart teeth defining a plurality of gaps therebetween, said teeth terminating in distal ends which collectively define a teeth profile line;

support means for supporting the gear rack in a fixed position with the row of teeth extending upwardly;

a gear member having a first support wall and a second support wall and at least two pin members extending between and intercoupling the support walls;

a holding means for (i) intercoupling the gear member and the gear rack, (ii) defining an axis of rotation of the gear member, and (iii) holding said gear member in a rotatable disposition relative to said gear rack such that the axis of rotation of said gear member bisects said gear rack and thereby resides interiorly of the teeth profile line;

a load-bearing member projecting from the holding means;

wherein the gear member and gear rack are cooperatively configured, dimensioned and positioned such that rotational movement of said gear member causes the pin members to move into and out of the gaps and engage against the teeth to thereby advance the gear member, holding means and load-bearing member along the gear rack;

a support body formed in part from the gear rack, said support body including an elongate skid surface, wherein the gear rack and the skid surface extend in parallel directions.

16. The lifting jack of claim 15, wherein the support body comprises an elongate central wall intercoupling the skid surface and the gear rack, said central wall extending orthogonally between and with respect to the skid surface and the gear rack, and being attached at mid-portions of said skid surface and gear rack, such that a cross section of the support body resembles an "I" shape.

17. The lifting jack of claim 16, wherein the holding means comprises a gear housing that slidably circumscribes the gear rack, said gear housing including an upper wall having an "I" shaped throughpassage formed therein, said "I" shaped throughpassage being configured and dimensioned for receiving the support body therethrough.

18. A lifting jack comprising:

a gear rack having a row of spaced-apart teeth defining a plurality of gaps therebetween, said teeth terminating in distal ends which collectively define a teeth profile line;

support means for supporting the gear rack in a fixed position with the row of teeth extending upwardly;

a gear member having a first support wall and a second support wall and at least two pin members extending between and intercoupling the support walls;

a holding means for (i) intercoupling the gear member and the gear rack, (ii) defining an axis of rotation of the gear member, and (iii) holding said gear member in a rotatable disposition relative to said gear rack such that the axis of rotation of said gear member bisects said gear rack and thereby resides interiorly of the teeth profile line;

a load-bearing member projecting from the holding means;

wherein the gear member and gear rack are cooperatively configured, dimensioned and positioned such that rotational movement of said gear member causes the pin members to move into and out of the gaps and engage against the teeth to thereby advance the gear member, holding means and load-bearing member along the gear rack;

a handle member releasably attachable to the gear member;

wherein the gear member includes a throughpassage formed therein of a size and shape for receiving the handle member therethrough, said jack further comprising a set screw threadably engaged in the gear member sufficient to engage against the handle member responsive to turning of said set screw to thereby enable said handle member to be extendable out of and retractable into the throughpassage of the gear member.

19. A lifting jack comprising:

a gear rack having a row of spaced-apart teeth defining a plurality of gaps therebetween, said teeth terminating in distal ends which collectively define a teeth profile line;

support means for supporting the gear rack in a fixed position with the row of teeth extending upwardly;

a gear member having a first support wall and a second support wall and at least two pin members extending between and intercoupling the support walls;

a holding means for (i) intercoupling the gear member and the gear rack, (ii) defining an axis of rotation of the gear member, and (iii) holding said gear member in a rotatable disposition relative to said gear rack such that the axis of rotation of said gear member bisects said gear rack and thereby resides interiorly of the teeth profile line;

a load-bearing member projecting from the holding means;

wherein the gear member and gear rack are cooperatively configured, dimensioned and positioned such that rotational movement of said gear member causes the pin members to move into and out of the gaps and engage against the teeth to thereby advance the gear member, holding means and load-bearing member along the gear rack;

wherein the pin members each include a rotatably disposed bushing.

20. A lifting jack comprising:

a gear rack having a row of spaced-apart teeth defining a plurality of gaps therebetween, said teeth terminating in distal ends which collectively define a teeth profile line;

support means for supporting the gear rack in a fixed position with the row of teeth extending upwardly;

a gear member having a first support wall and a second support wall and at least two pin members extending between and intercoupling the support walls;

a holding means for (i) intercoupling the gear member and the gear rack, (ii) defining an axis of rotation of the gear member, and (iii) holding said gear member in a rotatable disposition relative to said gear rack such that the axis of rotation of said gear member bisects said gear rack and thereby resides interiorly of the teeth profile line;

a load-bearing member projecting from the holding means;

a safety means pivotally disposed on the holding means for engaging the teeth of the gear rack to thereby inhibit backspin movement of the gear member; and a support body formed in part from the gear rack, said support body including an elongate skid surface, wherein the gear rack and the skid surface extend in parallel directions;

wherein the gear member and gear rack are cooperatively configured, dimensioned and positioned such that rotational movement of said gear member causes the pin members to move into and out of the gaps and engage against the teeth to thereby advance the gear member, holding means and load-bearing member along the gear rack;

wherein the safety means further comprises at least one finger configured and dimensioned to be insertable into the gaps between the teeth of the gear rack, and a spring means for retractably pivoting the finger toward the gear teeth;

wherein each pin member has opposing ends and is sandwiched at said ends between the support walls of the gear member such that at least a majority operative length of each pin member is suspended between said support walls and free from any lateral attachment to rigid structure such that said majority operative length of each pin is completely surrounded by atmosphere, and wherein the holding means includes a means for holding the gear member in a manner such that the axis of rotation is maintained at a fixed distance with respect to the teeth profile line during movement of said gear member along the gear rack;

wherein the pin members have diameters and wherein the gaps formed between the teeth have a length that is longer than the diameter of any of the pin members;

wherein the movement of the pin members into the gaps terminates at a fully inserted position, and wherein each gap is bounded by an interior edge of the gear rack and wherein a clearance space resides between said interior edge and a pin member when said pin member resides in the fully inserted position within said gap;

wherein each pin defines a pin axis, and wherein each pin axis bisects the gear rack, and thereby resides interiorly of the teeth profile line, when said pin resides in the fully inserted position within a gap;

wherein the pin members define a separation distance therebetween, and wherein each pin has a pin axis that defines a pin overlap distance from the teeth profile line when said pin resides in the fully inserted position within a gap, and wherein a ratio of the pin overlap distance to the separation distance is within a range of approximately 0.7 to 1.3;

wherein the support means comprises a support base secured to the gear rack and being adapted to hold said gear rack in a substantially vertically disposed orientation;

wherein the holding means includes a means for holding the gear member in a manner such that the axis of rotation is maintained at a fixed distance with respect to the teeth profile line during movement of said gear member along the gear rack, such that said axis of rotation is confined to movement along a movement path that is parallel to the teeth profile line;

wherein the gear member is rotatably disposed in the holding means for rotational movement in either of first and second opposing rotational directions, and wherein the gear member and gear rack are cooperatively configured, dimensioned and positioned such that (i) rotational movement of the gear member in the first rotational direction causes the pin members to engage upper surfaces of the teeth to thereby advance the gear member, holding means and load-bearing member in a first direction along the gear rack, and (ii) rotational movement of the gear member in the second rotational direction causes the pin members to engage under surfaces of the teeth to thereby advance the gear member, holding means and load-bearing member in an opposing second direction along the gear rack;

wherein each pin axes and the axis of rotation of the gear member are all disposed in a parallel orientation and all reside common to a single plane, such that both of the pin axes reside interiorly of the teeth profile line at one position of the rotatably disposed gear member to thereby enable simultaneous engagement of both pin members against upper surface of the teeth at said one position;

wherein the pin members are cylindrical in shape to thereby cause said pin members to simultaneously impose forces normal to and against the upper surface of the teeth at said one position;

wherein the holding means comprises a gear housing that slidably circumscribes the gear rack;

wherein the support body comprises an elongate central wall intercoupling the skid surface and the gear rack, said central wall extending orthogonally between and with respect to the skid surface and the gear rack, and being attached at mid-portions of said skid surface and gear rack, such that a cross section of the support body resembles an "I" shape;

wherein the holding means comprises a gear housing that slidably circumscribes the gear rack, said gear housing including an upper wall having an "I" shaped through-passage formed therein, said "I" shaped through passage being configured and dimensioned for receiving the support body therethrough.

* * * * *